US008206166B2

(12) United States Patent
Qu et al.

(10) Patent No.: US 8,206,166 B2
(45) Date of Patent: Jun. 26, 2012

(54) CARD CONNECTOR

(75) Inventors: Zhi-Cheng Qu, Guang-Dong (CN); Yun-Xiang Liu, Guang-Dong (CN); Bing-Tao Yang, Guang-Dong (CN); Yin-Lung Wu, Tu-Cheng (CN); Ming-Chiang Chen, Tu-Cheng (CN)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/899,525

(22) Filed: Oct. 6, 2010

(65) Prior Publication Data

US 2012/0088383 A1 Apr. 12, 2012

(51) Int. Cl.
*H01R 29/00* (2006.01)

(52) U.S. Cl. ..... 439/188

(58) Field of Classification Search ..... 439/188, 439/489, 360; 200/50.01, 51.1
See application file for complete search history.

(56) References Cited

U.S. PATENT DOCUMENTS 6,899,557 B2 * 5/2005 Hirata ..... 439/188

* cited by examiner

*Primary Examiner* — Alexander Gilman
(74) *Attorney, Agent, or Firm* — Cheng-Ju Chiang

(57) ABSTRACT

A card connector includes an insulating housing, a shell covering on the insulating housing to define a card receiving space between the cover and the insulating housing for being inserted into a card along an insertion direction, a plurality of contacts received in the insulating housing and extended into the card receiving space, a first switch terminal and a second switch respectively positioned at a right side of the insulating housing. The first switch terminal includes a main section extended along the insertion direction, a first straight section and a second straight section successively and slantwise extended into the card receiving space form a free end of the first main section to respectively define a first slope and a second slope relative to the main section. The second switch terminal includes a contacting section extending beside the first straight section. The second slope is larger than the first slope.

15 Claims, 6 Drawing Sheets

CARD CONNECTOR

BACKGROUND OF THE INVENTION

1. Field of the Invention

The present invention relates to an card connector, more specifically, to a card connector with a detecting structure.

2. The Related Art

Nowadays, with progress of the electrical technology, electrical apparatuses become compact and multifunction. Generally, an electrical apparatus can access a memory card through a memory card connector. Various memory cards such as MS (Memory Stick) card, SD (Secure Digital Memory) card, Mini SD card, MMC (Multi Media) card, are developed for adapting to various electrical apparatuses.

Since, various memory card connectors are developed for connecting to the memory cards. Because the memory card connector interconnects the memory card and the electrical apparatus for transmitting data therethrough, it must have compact size, strong structure for long time use.

a conventional card connector has an insulating housing and a metal shell covering and engaging with the insulating housing. The insulating housing and the metal shell together define a card receiving space therebetween for receiving a memory card. The insulating housing defines a plurality of grooves for receiving contacts. The contacts interconnect the memory card and a printed circuit board. The memory card connector further has a detecting structure for detecting the memory card and then enabling data transmission between the memory card and the printed circuit board.

The detecting structure has a first switch terminal and a second switch terminal. If the memory card inserts into the card receiving space of the card connector, the memory card will press the first switch terminal to connect to the second switch terminal.

Because the first switch terminal is directly pressed by the memory card and the second switch terminal is indirectly pressed by the memory card to move. If the movement of the first switch terminal and the second switch terminal exceeds the elastic of the first switch terminal and the second switch terminal, the first switch terminal and the second switch terminal may deform. Since, the detecting structure will be unstable to detect the memory card.

SUMMARY OF THE INVENTION

An object of the present invention is to provide a card connector.

According to the invention, the card connector is inserted into a card and includes an insulating, a plurality of contacts and a detecting structure. The insulating housing defines a card receiving space to be inserted the card along an insertion direction. The contacts are received in the insulating housing and extended into the card receiving space.

The detecting structure is positioned at a lateral side of the insulating housing and includes a first switch terminal and a second switch terminal. The first switch terminal includes a first main section, first slating section and a second slanting section.

The first main section is extended along the insertion direction. The first slating section is slantwise extended into the card receiving space form a free end of the first main section to form a first slope relative to the first main section. The second slanting section is slantwise extended into the card receiving space from the free end of the first slating section to form a second slope relative to the first main section.

The second switch terminal comprising a contacting section positioned beside the first slating section. The first slanting section of the first switch terminal is positioned between the card receiving space and the contacting section of the second switch terminal. The second slope is larger than the first slope.

Another object of the present invention is to provide a card connector.

According to the invention, the card connector is inserted into a card and includes an insulating housing, a shell, a card receiving space, a plurality of contacts, a first switch terminal and a second switch terminal. The insulating housing defines a right side, a left side, a front side and a rear side. The shell covers on the insulating housing.

The card receiving space is defined between the shell and the insulating housing and inserted the card along an insertion direction. The contacts engage with the insulating housing and extend into the card receiving space. The first switch terminal is positioned at the right side of the insulating housing and includes a first main section, a first slating section and a second slating section.

The first slating section and the second slating section are successively and slantwise extended into the card receiving space and extended toward the rear side of the insulating housing form a free end of the first main section to respectively define a first slope and a second slope relative to the first main section.

The second switch terminal is positioned at the right side of the insulating housing and includes a contacting section extending beside the first slating section. The first slanting section of the first switch terminal is positioned between the contacting section of the second switch terminal and the card receiving space. The second slope is larger than the first slope.

Another object of the present invention is to provide a card connector.

According to the invention, the card connector is inserted a card and includes an insulating housing, a shell, a card receiving space, a plurality of contacts, a first switch terminal and a second switch terminal. The insulating housing defines a right side, a left side, a front side and a rear side. The shell covers on the insulating housing. The card receiving space is defined between the shell and the insulating housing to be inserted the card along an insertion direction.

The contacts are received in the insulating housing and extended into the card receiving space. The first switch terminal is positioned at the right side of the insulating housing and includes a main section, a first straight section and a second straight section. The main section is extended along the insertion direction.

The first straight section and the second straight section re successively and slantwise extended into the card receiving space and extended toward the rear side of the insulating housing form a free end of the first main section to respectively define a first slope and a second slope relative to the main section.

The second switch terminal is positioned at the right side of the insulating housing and includes a contacting section extending beside the first straight section of the first switch terminal. The first slanting section of the first switch terminal is positioned between the contacting section of the second switch terminal and the card receiving space. The second slope is larger than the first slope.

Because and the second slope is larger than the first slope, a first travel between the card and the first switch terminal is longer than a second travel between the first switch terminal and the second switch terminal if the card is inserted into the card receiving space to continuously contact to and slide along the first slanting section and the second slanting section of the first switch terminal to urge the first switch terminal to continuously contact to and slide along the contacting section of the second switch terminal Since, it can prevent the second switch terminal from deformation.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENT

Figure 1:
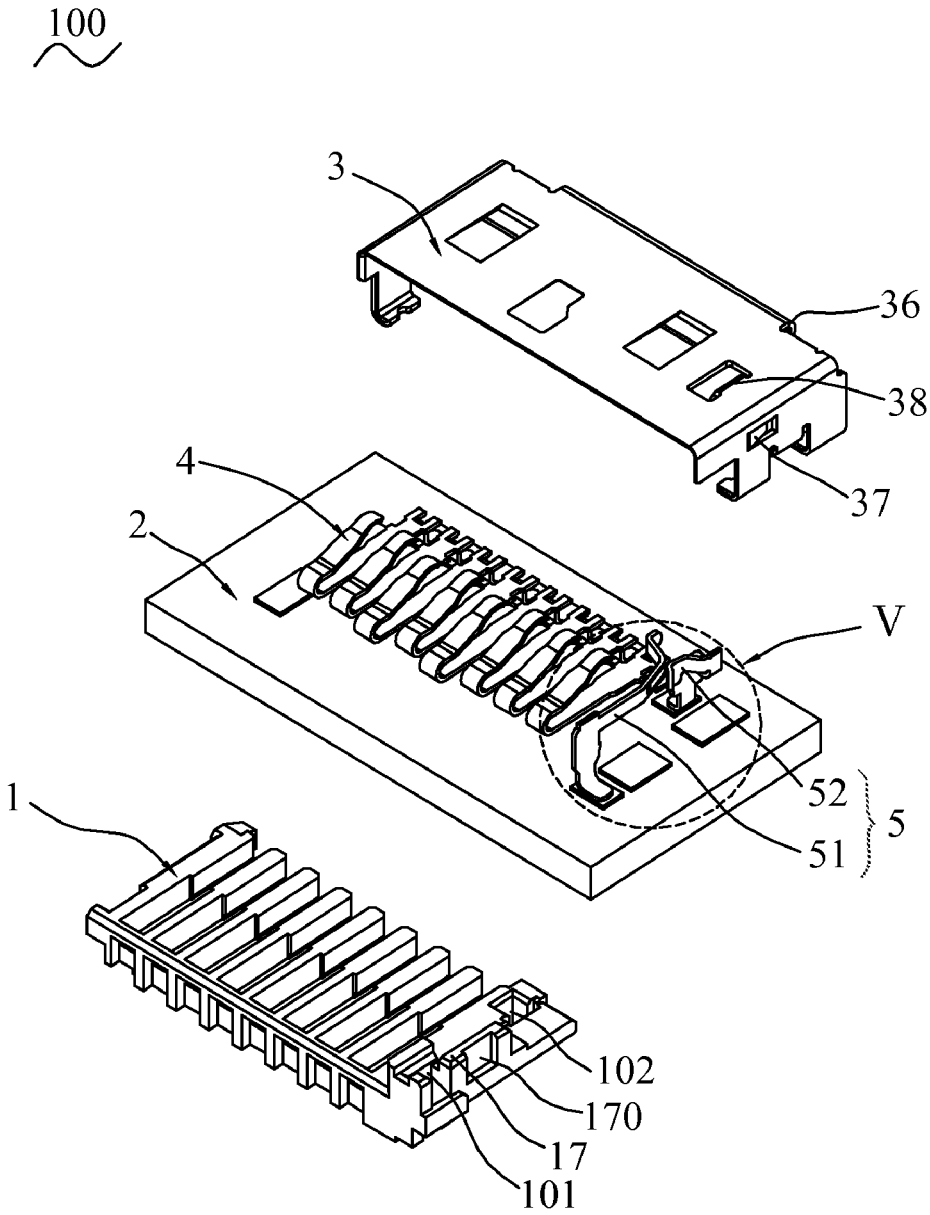
FIG. 1 is an exploded view of a card connector according to the present invention.
Figure 2:
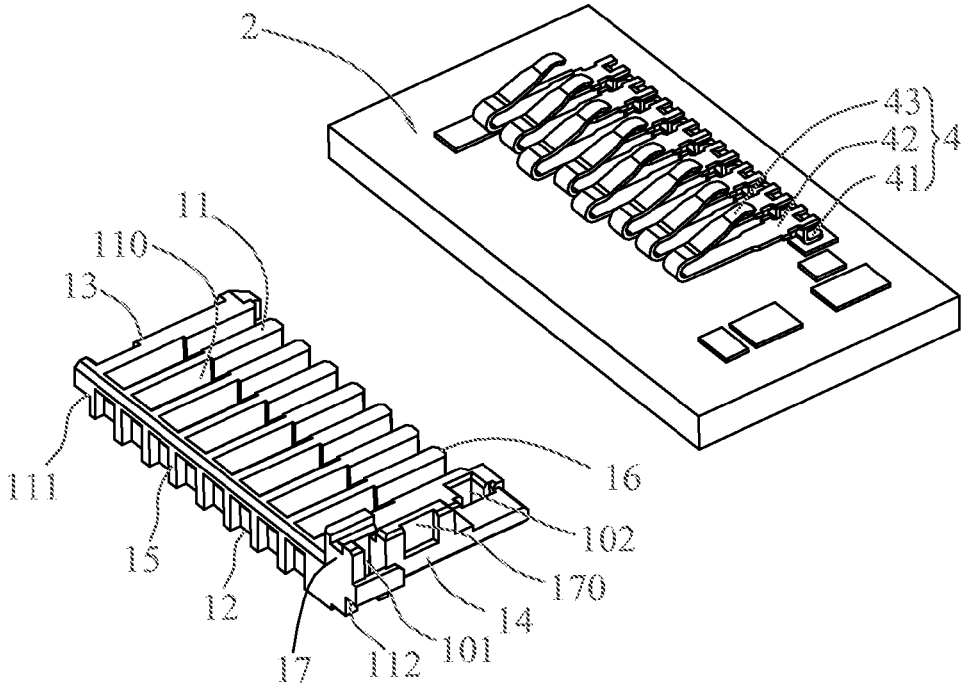
FIG. 2 is a an exploded view of a card connector showing an insulating housing and contacts and a printed circuit board according to the present invention.

Please refer to FIG. 1 and FIG. 2. A preferred embodiment of a card connector 100 adapts to receive a Micro SD card 6. The card connector 100 includes an insulating housing 1, a shell 3, a plurality of contacts 4 and a detecting structure 5. The insulating housing 1 is formed as a rectangular shape and mounted on a printed circuit board 2. The insulating housing 1 includes a top surface 11, a bottom surface 12 opposite to the top surface 11, a left surface 13, a right surface 14 opposite to the left surface 13, a front surface 15 and a rear surface 16 opposite to the front surface 15.

The top surface 11 of the insulating housing 1 defines a plurality of grooves 110 for respectively receiving the contacts 4. Especially, the grooves 110 penetrate the rear surface 16 of the insulating housing 1. The left surface 13 of the insulating housing 1 defines a left concave 111, and the right surface 14 of the insulating housing 1 defines a right concave 112.

The top surface 11 of the insulating housing 1 is formed a projection 17. The projection 17 is connected to the right surface 13 of the insulating housing 1. The right surface 13 of the insulating housing 1 defines a notch 170 formed at the projection 17. The projection 17 defines a first channel 101 and a second channel 102. The first channel 101 and the second channel 102 penetrate a top surface of the projection 17 and the bottom surface 12 of the insulating housing 1. The first channel 101 is close to the front surface 15 of the insulating housing 1, and the second channel 102 is close to the rear surface 16 of the insulating housing 1.

Each of the contacts 4 includes a main portion 42, a soldering portion 41 and a connecting portion 43. The main portion 42 is received in the groove 110 of the insulating housing 1. The soldering portion 41 is extended from one end of the main portion 42 and bent downwardly to the bottom surface 12 of the insulating housing 1. Especially, the soldering portion 41 is parallel with the bottom surface 12 of the insulating housing 1 and soldered to the printed circuit board 2. The connecting portion 41 is extended upwardly from the other end of the main portion 43 and to the top surface 11 of the insulating housing 1. The connecting portion 43 is bent to form as an arc-shaped for connecting to the Micro SD card 6.

Figure 3:
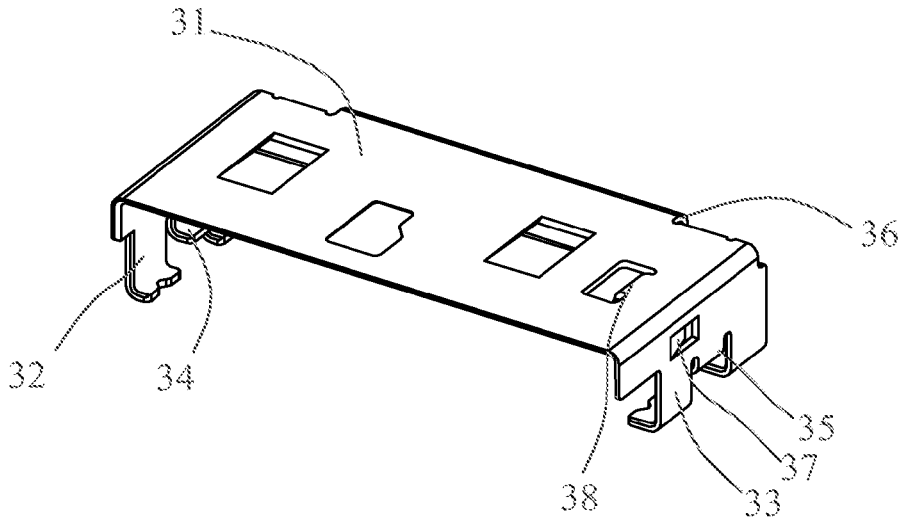
FIG. 3 is a perspective view of a metal shell of the card connector according to the present invention.
Figure 4:
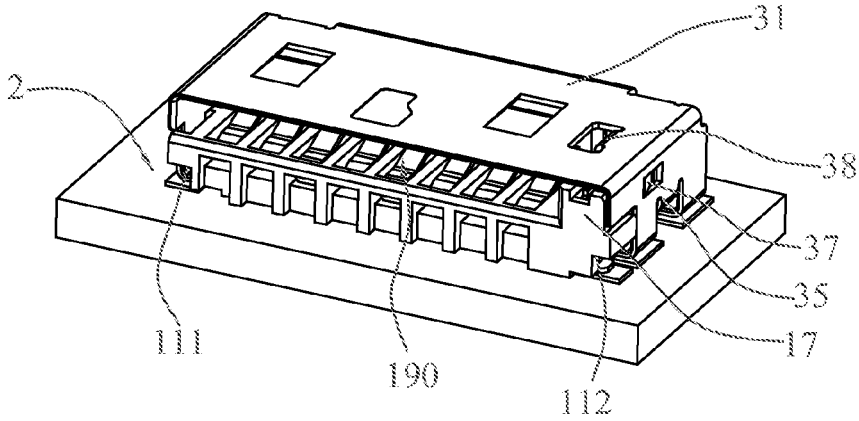
FIG. 4 is a perspective view of the card connector according to the present invention.

Please refer to FIG. 3 and FIG. 4. The shell 3 is made of a metal foil. The shell 3 covers the top surface 11, the left surface 13 and the right surface 14 of the insulating housing 1. The shell 3 and the insulating housing 1 together define a card receiving space 190 therebetween. The grooves 110 of the insulating housing 1 connect to the card receiving space 190.

The shell 3 includes a top plate 31, a left plate 32 and a right plate 33. The left plate 32 is extended downwardly from a left side of the top plate 31. The right plate 32 is extended downwardly from a right side of the top plate 31. The top plate 31 covers the top surface 11 of the insulating housing 1. The left plate 32 covers the left surface 13 of insulating housing 1. The right plate 33 covers the right surface 14 of the insulating housing 1.

The left plate 32 of the shell 3 is extended inwardly to form a left tab 34. The right plate 33 of the shell 3 is extended inwardly to form a right tab 35. The left tab 34 and the right tab 35 are respectively engaged into the left concave 111 and the right concave 112 of the insulating housing 1. A rear side of the top plate 31 of the shell 3 is extended downwardly to form a stopping plate 36 to block the Micro SD card 6 and prevent the Micro SD card from over insertion. The right plate 33 of the shell 3 is punched inwardly to form a wedge 37 for engaging with the notch 170 of the insulating housing 1. The top plate 31 of the shell is punched downwardly to form a restricting tab 38.

Figure 5:
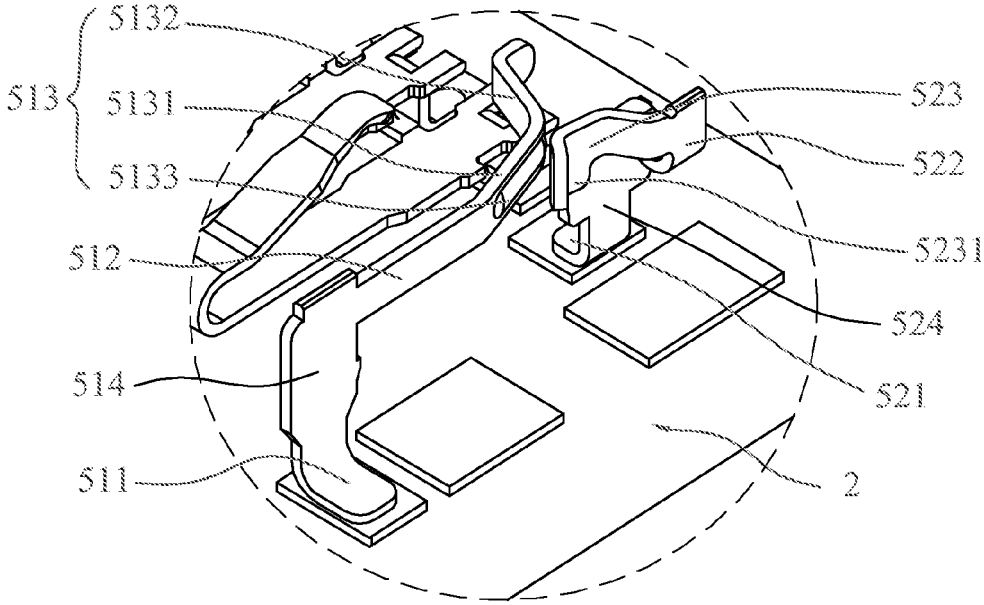
FIG. 5 is a partial view of a detecting structure in FIG. 1.
Figure 6:
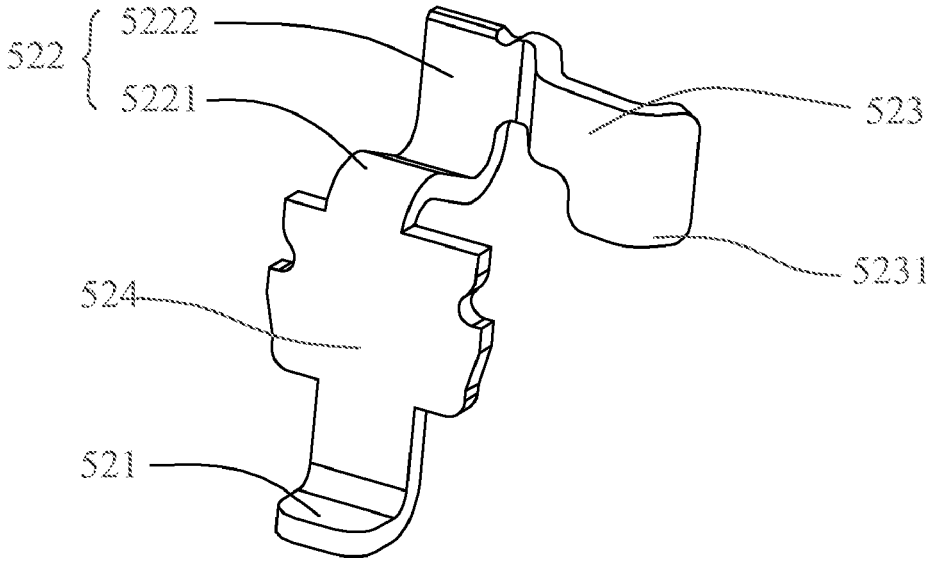
FIG. 6 is a perspective view of a second switch terminal of the card connector.
Figure 7:
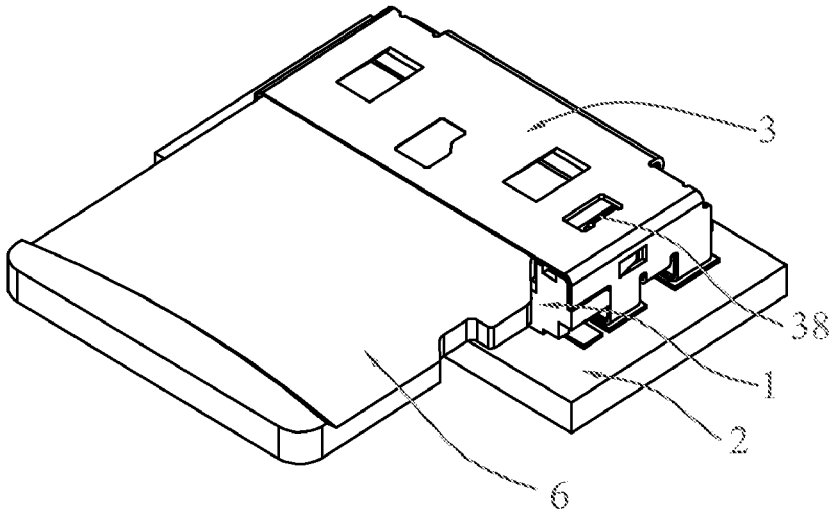
FIG. 7 is a perspective view showing a memory card inserted into the card connector.
Figure 8:
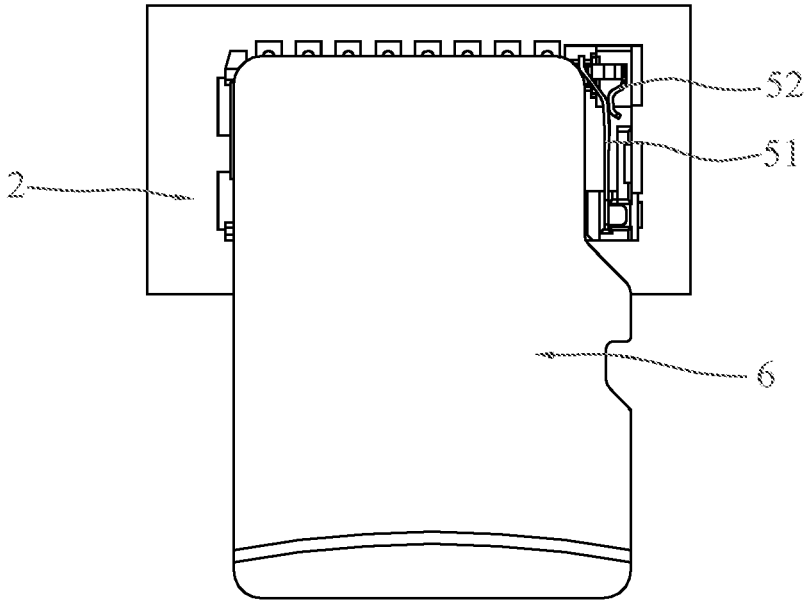
FIG. 8 shows the memory card completely inserted into the card connector.
Figure 9:
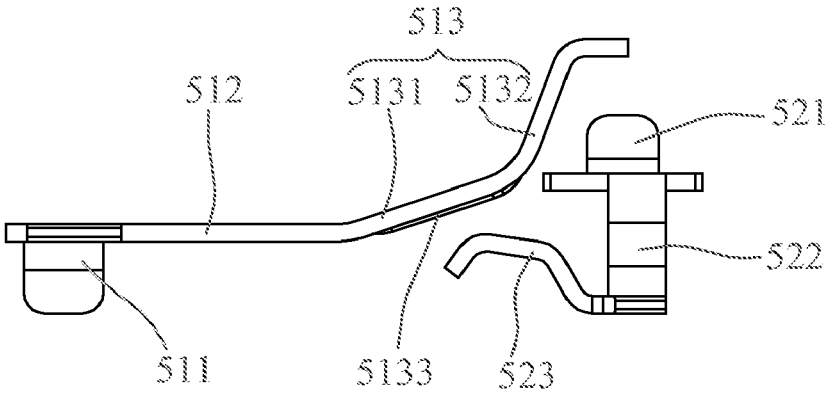
FIG. 9 shows the first switch terminal separated from the second switch terminal.
Figure 10:
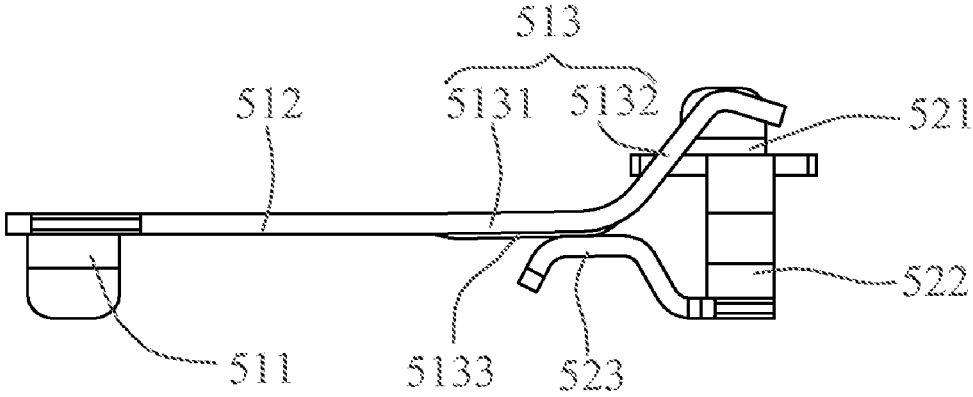
FIG. 10 shows the first switch terminal connected to the second switch terminal.

Please refer to FIG. 5 and FIG. 6. The detecting structure 5 includes a first switch terminal 51 and a second switch terminal 52. The first switch terminal 51 and the second switch terminal 52 are respectively engaged with the first channel 101 and the second channel 102 of the insulating housing 1.

The first switch terminal 51 is substantially formed as a L-shaped strip. The first switch terminal 51 includes a first main section 512, a first soldering section 511, a first contacting section 513 and a first fixing section 514. The first main section 512 is extended along an insertion direction of the Micro SD card 6. The first fixing section 514 is extended downwardly from one end of the first main section 512. The first fixing portion 514 is engaged in the first channel 101. The first soldering section 511 is bent from the free end of the first fixing section 514 to be soldered to the printed circuit board 2.

The first contacting section 513 is extended inwardly from the other end of the main section 512 and into the card receiving space 190. The first contacting section 513 includes a first slanting section 5131 and a second slanting section 5132. The first slating section 5131 interconnects between the first main section 512 and the second slating section 5132.

The first slating section 5131 is bent inwardly from the other end of the first main section 512 to form a first slope relative to the first main section 512. The second slating section 5132 is bent inwardly from the first slating section 5131 to form a second slope relative to the first main section 512. The first slope is smaller than the second slope. Especially, a length of the first slating section 5131 is larger than a length of the second slating section 5132. Especially, the first slating section 5131 is punched outwardly to form a rib 5133.

The second switch terminal 52 includes a second main section 522, a second soldering section, 521, a second contacting section 523 and a second fixing section 524. The second main section 522 extends to perpendicular to the insertion direction of the Micro SD card 6. The second main section 522 is substantially formed as an L shape to include a horizontal section 5221 and a vertical section 5222. Especially, the horizontal section 5221 is substantially formed as an S shape.

The second fixing section 524 is extended downwardly from the free end of the horizontal section 5221 to engage in the second channel 102 of the insulating housing 1. The second soldering section 521 is bent from the free end of the second fixing section 524 to be soldered to the printed circuit board 2. The second contacting section 523 is extended from the free end of the vertical section 5222 and extended inwardly and toward the front surface 15 of the insulating housing 1 to form a bent shape. A bottom edge of the second contacting section 524 is extended downwardly to form a contacting tab 5231.

If the card connector 100 is assembled, the contacts 4 are respectively inserted into the grooves 101 of the insulating housing 1 from the rear surface 16. The first switch terminal 51 and the second switch terminal 52 are respectively engaged in the first channel 101 and the second channel 102 of the insulating housing 1.

The shell 3 engages with and covers the insulating housing 1. Since, the left tab 34 and the right tab 35 of the shell 3 are respectively engaged with the left concave 111 and the right concave 112 of the insulating housing 1. The card receiving space 190 is therefore formed between the insulating housing 1 and the shell 3.

The restricting tab 38 is positioned between the card receiving space 190 and the first main section 512 of the first switch terminal 51 to separate the Micro SD card 6 from the first main section 512 of the first switch terminal 51 if the Micro SD card 6 is inserted into the card receiving space 190. Especially, the restricting tab 38 can prevent the first main section 512 from being pressed by the Micro SD card 6 if the Micro SD card 6 is slantwise inserted into card receiving space 190. Since, the restricting tab 38 of the shell 3 can prevent the first switch terminal 51 of the detecting structure 5 from erroneous action.

Please refer to FIG. 7 to FIG. 10. If the Micro SD card 6 is not inserted into the card receiving space 190 of the card connector 100, the first switch terminal 51 and the second switch terminal 52 are separated from each other. If the Micro SD card 6 is shallowly inserted into the card receiving space 190 of the card connector 100, the Micro SD card 6 contacts and presses the first slanting section 5131 of the first switch terminal 51 to travel toward the second switch terminal 52.

If the Micro SD card 6 is completely inserted into the card receiving space 190 of the card connector 100, the Micro SD card 6 continuously contacts to, slides on and presses the first slating section 5131 and then contacts to and presses the second slanting section 5131. Since, the rib 5133 of the first slating section 5131 is pressed to contact to and slides on the contacting tab 5231 of the switch terminal 52.

Especially, the Micro SD card 6 slides on the first slating section 5131 and the second slating section 5132 of the first switch terminal 51 to form a first travel, the rib 5133 of the first switch terminal 51 slides on the contacting tab 5231 of the second switch terminal 52 to form a second travel. The first travel is longer than the second travel.

Because the first travel is longer than the second travel, it can prevent the second switch terminal 52 from deformation. Since, the stability and the structure of the detecting structure 5 can be improved. Because the rib 5133 of the first switch terminal 51 slides on and contacts to the contacting tab 5231 of the bent-shape second switch terminal 52, the second contacting section 523 is pressed to move outwardly and swing laterally. Since, the stress applied on the second switch terminal 52 can be reduced to prevent the second switch terminal 52 from deformation.

As described above, because the first slating section 5131 is bent inwardly to form a first slope relative to the first main section 512, the second slating section 5132 is bent inwardly to form a second slope relative to the first main section 512 and the first slope is smaller than the second slope, the first travel between the Micro SD card 6 and the first switch terminal 51 is longer than the second travel between the first switch terminal 51 and the second switch terminal 52 to prevent the second switch terminal 52 from deformation.

Furthermore, because the rib 5133 of the first switch terminal 51 slides on and contacts to the contacting tab 5231 of the bent-shape second switch terminal 52, the second contacting section 523 is pressed to move outwardly and swing laterally to reduce the stress applied on the second switch terminal 52 to prevent the second switch terminal 52 from deformation. Since, the stability and structure of the detecting structure 5 of the card connector 100 is improved.

Furthermore, the present invention is not limited to the embodiments described above; diverse additions, alterations and the like may be made within the scope of the present invention by a person skilled in the art. For example, respective embodiments may be appropriately combined.

What is claimed is:

1. A card connector to be inserted a card, comprising:

an insulating housing defining a card receiving space to be inserted the card along an insertion direction;

a plurality of contacts received in the insulating housing and extended into the card receiving space; and a detecting structure being positioned at a lateral side of the insulating housing and comprising:

a first switch terminal comprising:

a first main section extended along the insertion direction;

a first contacting section comprising a first slating section and a second slanting section, the first slating section slantwise extended into the card receiving space from a free end of the first main section to form a first slope relative to the first main section; the second slanting section slantwise extended into the card receiving space from the free end of the first slating section to form a second slope relative to the first main section; and a second switch terminal comprising a second contacting section and a second main section, the second contacting section extending from an outside end of the second main section to be positioned beside the first slating section and bent toward the first slanting section, the second main section being extended transversely and perpendicularly to the insertion direction; and wherein the first slanting section of the first switch terminal is positioned between the second contacting section of the second switch terminal and the receiving space, the second slope being larger than the first slope.

2. The card connector as claimed in claim 1, wherein the first slanting section of the first switch terminal is punched outwardly to form a rib.

3. The card connector as claimed in claim 2, wherein the second contacting section of the second switch terminal is extended downwardly to form a contacting tab facing the rib of the first slanting section of the first switch section.

4. The card connector as claimed in claim 3, wherein the insulating housing defines a front surface and a rear surface, the first switch terminal comprises a first fixing section extended downwardly from the other end of the first main section and positioned close to the front surface of the insulating housing to engage with the insulating housing, the first slanting section and the second slating section are successively extended toward the rear surface of the insulating housing.

5. The card connector as claimed in claim 4, wherein the second switch terminal comprises a second fixing section extended downwardly from an inner end of the second main section and positioned close to the rear surface of the insulating housing to engage with the insulating housing, the second contacting section is extended toward the front surface of the insulating housing.

6. The card connector as claimed in claim 5, wherein the insulating housing defines a right side and a left side, the insulating housing forms a projection at a right side thereof, the insulating housing defines a first channel close to the front surface and vertically penetrating the projection and the insulating housing for engaging with the first fixing section of the first switch terminal, and a second channel close to the rear surface and vertically penetrating the projection and the insulating housing for engaging with the second fixing section of the second switch terminal.

7. The card connector as claimed in claim 6, wherein the second main section comprises a horizontal section and a vertical section, the second fixing section is extended downwardly from an inner end of the horizontal section, the vertical section is extended upwardly from an outer end of the horizontal section, the contacting section is extended forwardly from the free end of the vertical section.

8. The card connector as claimed in claim 7, wherein the insulating housing is covered by a shell, the card receiving space is defined between the insulating housing and the shell, the shell comprises a top plate covering the card receiving space, a right plate extending downwardly from a right side of the top plate to cover the right side of the insulating housing, and a left side extending downwardly from a left side of the top plate to cover the left side of the insulating housing, the insulating housing defines a right concave at the right side thereof and a left concave at the left side thereof, the right plate of the shell is bent inwardly to form a right tab for engaging with the right concave of the insulating housing, the left plate of the shell is bent inwardly to form a left tab for engaging the left concave of the insulating housing.

9. The card connector as claimed in claim 8, wherein the right plate of the shell is punched inwardly to form a wedge, the right side of the insulating housing defines a notch to engage with the wedge.

10. The card connector as claimed in claim 9, wherein the top plate of the shell is punched downwardly to form a restricting tab positioned between the first main section of the first switch terminal and the card receiving space.

11. The card connector as claimed in claim 10, wherein the top plate of the shell defines a rear edge, the rear edge of the shell is extended downwardly to form a stopping plate.

12. A card connector to be inserted a card, comprising:

an insulating housing defining a right side, a left side, a front side and a rear side;

a shell covering on the insulating housing;

a card receiving space defined between the shell and the insulating housing to be inserted the card along an insertion direction;

a plurality of contacts engaging with the insulating housing and extending into the card receiving space;

a first switch terminal being positioned at the right side of the insulating housing and comprising:

a first main section extending along the insertion direction; and a first contacting section comprising a first slating section and a second slating section successively and slantwise extending into the card receiving space and extending toward the rear side of the insulating housing form a free end of the first main section to respectively define a first slope and a second slope relative to the first main section; and a second switch terminal being positioned at the right side of the insulating housing and comprising a second contacting section and a second main section, the second main section extending transversely and perpendicularly to the insertion direction, the second contacting section extending beside the first slating section and from an outside end of the second main section, and being bent toward the first slanting section;

wherein the first slanting section of the first switch terminal is positioned between the second contacting section of the second switch terminal and the card receiving space, the second slope being larger than the first slope.

13. The card connector as claimed in claim 12, wherein the first slanting section of the first switch terminal is punched outwardly to form a rib.

14. The card connector as claimed in claim 13, wherein the second contacting section of the second switch terminal is extended downwardly to form a contacting tab facing the rib of the first slanting section of the first switch section.

15. The card connector as claimed in claim 14, wherein a length of the first slanting section is longer than a length of the second slanting section of the first switch terminal.

* * * * *